US005110060A

United States Patent [19]

Lundquist

[11] Patent Number: 5,110,060

[45] Date of Patent: May 5, 1992

[54] CUTTER ENHANCEMENT FOR PLASTIC SIZE REDUCTION EQUIPMENT

[76] Inventor: Lynn C. Lundquist, 10833 NE. Russell, Portland, Oreg. 97220

[21] Appl. No.: 595,258

[22] Filed: Oct. 9, 1990

[51] Int. Cl.[5] ..... B02C 18/18

[52] U.S. Cl. ..... 241/158; 241/236; 83/501

[58] Field of Search ..... 241/285 R, 285 A, 285 B, 241/236, 242, 101.7, 101.2, 166, 167, 158; 83/501, 502

[56] References Cited

U.S. PATENT DOCUMENTS

| | | | |
|---|---|---|---|
| 2,101,700 | 12/1937 | Chestnut | 241/236 X |
| 3,960,335 | 6/1976 | Häberle | 241/236 |
| 4,257,565 | 3/1981 | Hatanaka | 241/236 X |
| 4,565,330 | 1/1986 | Katoh | 241/236 |

FOREIGN PATENT DOCUMENTS

| | | | |
|---|---|---|---|
| 0010681 | 5/1980 | European Pat. Off. | 241/236 |
| 2845447 | 4/1980 | Fed. Rep. of Germany | 241/236 |
| 2905906 | 8/1980 | Fed. Rep. of Germany | 241/236 |
| 3313231 | 10/1984 | Fed. Rep. of Germany | 241/236 |
| 3705623 | 9/1988 | Fed. Rep. of Germany | 241/236 |
| 45173 | 7/1935 | France | 241/236 |
| 516769 | 6/1977 | U.S.S.R. | 241/242 |
| 2171028 | 8/1986 | United Kingdom | 241/236 |

*Primary Examiner*—Mark Rosenbaum
*Attorney, Agent, or Firm*—Kolisch, Hartwell, Dickinson, McCormack & Heuser

[57] ABSTRACT

This invention pertains to the cutter area of size reduction equipment for plastic or other waste material. The primary objective of the invention is to provide a primary and secondary cutting area within the cutting head assembly so that the granulate is properly sized upon discharge. In the normal passage of the material through the cutter assembly, this reduction to a predetermined size is accomplished in the primary cutting area. However, if material inadvertently passes through the primary area without being properly sized, it will be appropriately dimensioned in the secondary cutting area prior to discharge. The invention pertains to a cutter mechanism which uses a single plane of counter rotating, alternating cutters in conjunction with a stationary cutting surface to achieve the primary and secondary cutting actions. The invention further addresses design considerations of the locating means of both the shaft mounted cutter assemblies and the stationary cutting surfaces. A final consideration of the invention is a means of facilitating quick removal and replacement of the cutter mechanism as an assembly.

10 Claims, 4 Drawing Sheets

CUTTER ENHANCEMENT FOR PLASTIC SIZE REDUCTION EQUIPMENT

BACKGROUND—FIELD OF THE INVENTION

This invention provides an improved cutter design for size reduction equipment as used in plastic or other waste material recovery systems. A first objective of the invention is to provide a cutter arrangement which provides predetermined, uniform granulate size for subsequent processing equipment. Other objectives will be shown in the following description.

Size reduction equipment has recently been developed for plastic and related industries which offers significant advantages over the prior art. An example of this size reduction equipment is Model BC-30 manufactured by Allegheny Recycling and Waste Reduction Equipment, Inc. of Delmont, Pa. (The aforementioned equipment is based on the patents of John W. Wagner, U.S. Pat. Nos. 4,018,392, 4,669,673, 4,729,515, and 4,750,678.) This equipment enhances reprocessing production by providing uniform granulate size among that portion of the granulate which has been properly formed. However, an inherent disadvantage of this equipment is the inadvertent production of a mix of properly formed granulate with improperly formed shreds.

The present invention is a further refinement of the cutter area of this newer equipment which eliminates shred formation. The result is a granulate with a predetermined, uniform size.

BACKGROUND—DESCRIPTION OF THE PRIOR ART

For the purposes of definition as used in describing the end product of the plastic size reduction process, the term "granulate" will mean any finished product after final processing, irrespective of size. The term "fine" will mean a granulate which is substantially less than that which is desired. The term "shred" will indicate a finished material which is properly sized in one dimension when viewed in a two dimension plane, but is of excessive length in the other. And finally, the term "chip" will mean a two dimensioned granulate which is formed with a prescribed dimension in both its length and width.

The bulk of the size reduction equipment currently employed in plastic and similar material processing consists of a stationary bed knife and rotating cutter blade assembly with an axis parallel to the cutting surface of said bed knife. Such equipment is illustrated by Shah (U.S. Pat. No. 3,897,016) and Leslie and Leslie (U.S. Pat. No. 4,706,899).

The final sizing of the recovered material in bed knife equipment is accomplished by passing the granulate through a formed screen. Extensive testing has established that the mean size of the reprocessed granulate has a surface area slightly over one-half the diameter of the screen hole. Upon statistical examination of the granulate, it can be appreciated that the size distribution of the screened material is randomly distributed by size defined by a bell shaped curve. That is, the mean surface area size of the granulate is approximately one-half screen size with a distribution of finer and coarser material to each side of the median.

It should be obvious to the trained observer that the processing horsepower requirements of this technology are in direct relationship to the size reduction of the granulate. That is, each cut of the individual granulate requires power input until said granulate is discharged from the screen area of the equipment. When size reduction takes place beyond optimum size requirements, such as when fines are produced, the horsepower requirements of the equipment are increased without a corresponding increase in material throughput or quality. In practice, it has been shown that the horsepower requirements for processing a given weight of material is considerably less when all size reduction to the material is accomplished in a single pass, as against multiple passes when the granulate size is allowed to exhibit a random distribution of size.

Thus, it can unequivocally be stated that size reduction equipment which processes the granulate in a single pass greatly reduces the power requirements for the process. Consequently, the equipment supplied by Allegheny Recycling and Waste Reduction Equipment, Inc. achieves a greatly enhanced throughput rate for a given horsepower as compared with bed knife systems. The Allegheny equipment is not the only application of this concept; Hatanaka (U.S. Pat. Nos. 4,260,115 and 4,690,340), Katoh (U.S. Pat. No. 4,565,330) Crane (U.S. Pat. No. 4,717,085) and Häberle (U.S. Pat. No. 3,960,335) show a cutter similar in arrangement to the Allegheny design.

However, effective as the Allegheny system is in reducing the power requirements of the process, it has the shortcoming of producing properly sized chips in combination with shreds. This is an acceptable approach if size reduction of waste is the sole objective. However, when reprocessing of the granulate is the objective (such as is the case in plastic recovery systems) the presence of shreds becomes a major obstacle.

This invention comprises an improvement on the cutter mounting and control of shreds over the Allegheny design. The Allegheny technology uses none of the unique claims of this invention. Furthermore, Allegheny has attempted to solve this shortcoming outside of the primary cutting chamber by adding a second cutting section with a fixed cutting blade and at least one rotating cutting blade for cutting the elongated pieces (shreds) into smaller second pieces, as stated in the first claim of U.S. Pat. No. 4,669,673.

As referred to earlier, any technology using stationary bed knives is deemed as unrelated to this invention. Such equipment is illustrated by Shah (U.S. Pat. No. 3,897,016), Leslie and Leslie (U.S. Pat. No. 4,706,899), Parker (U.S. Pat. No. 4,706,899), Perschbacher (U.S. Pat. No. 3,837,586) and others. By extension, Nakamura (U.S. Pat. No. 3,957,211) would be included in this category, though each rotating member is separated by stationary members perpendicular to the rotating shaft.

A prior art more closely related to this invention consists of various cutter designs in which opposing cutters with teeth arranged on their periphery overlap radially and are counter-rotating. Examples of this art would include the references cited above in conjunction with the Allegheny design.

Two patents by Hatanaka (U.S. Pat. Nos. 4,260,115 and 4,690,340), show a counter-rotating cutter and plate design which, on first encounter, would appear similar to the cutter and plate design of the present invention.

It should first be noted that this present invention is not making claims for either counter-rotating cutters, or any design features of said cutters. Thus, the claims of Hatanaka in this regard are irrelevant.

Secondly, it should be noted that the function of the separator plates is substantially different in Hatanaka. In the first patent (U.S. Pat. No. 4,260,115) Hatanaka uses the plate as a cutting surface. It should be noted, however, that the configuration of the plate at location 20a in conjunction with the chipper tooth configuration of the cutter is essentially the design of a stationary bed knife technology. That is, an abrupt abutment surface is presented to the cutter tooth. In the early development of the present invention, a similar design was attempted. It was found unsatisfactory inasmuch as torsional movement in the plate caused by heavy cutting rotates the stationary cutting face into the path of the cutter teeth. In a similar manner, this cutting arrangement is unsatisfactory when the cutter shafts are reversed to clear the machine as torsional forces on the stationary plates again move the stationary cutting face into the cutter in a mechanical braking action. (It is interesting to note that Hatanaka appears to abandon this first approach in the second patent U.S. Pat. No. 4,690,340.)

In reference to the similarities between Hatanaka's second patent and the present invention, it should be noted that, 1) Inasmuch as cutter geometry is not a concern of the present invention, it is not anticipated by Hatanaka. 2) The presence of dividing plates in both of Hatanaka's patents and the present invention perform the necessary function of preventing material from wrapping around the turning shaft, and facilitate its direction through the cutters. However, these functions are not a part of the claims of this invention, and therefore are not anticipated by Hatanaka or any others who use this technology. 3) The unique design of an internally radiused surface on the pinch plate of the present invention is unanticipated by any prior art when the clearances for operation are less than the nominal thickness of the material passing through the cutter. This design allows the cutters to rotate in either a forward or reverse direction without binding. It allows an adjustable movement to compensate for wear in either the pinch plate or in the cutters themselves. Finally, of greatest significance, in this invention the internally radiused surface is designed as a secondary cutting means for shreds passing beyond the primary chip forming area of the cutters.

Häberle (U.S. Pat. No. 3,960,335) shows a secondary cutting means on a shaft with two cutters of different size. Though this arrangement may achieve a similar end result, it does not anticipate that which this invention has achieved, inasmuch as the opposing surface is on the opposing rotating shaft rather than on a stationary surface.

The patent by Katoh (U.S. Pat. No. 4,565,330) merits particular scrutiny inasmuch as there is an internally radiused surface (B on plate 48) opposing the cutter discs. There are, however, significant differences between this invention and Katoh. It should be readily apparent to a trained observer that the plates in Katoh's design have a fixed mounting relative to the cutter teeth against which they work. This necessitates sufficient clearance to accommodate variations in manufacture, and affords no compensation for wear. It could not, therefore, be construed (nor does Katoh claim it to be) a surface against which a single sheet of material will be subsequently pierced because the material has a greater thickness than the clearance between the plate surface and the cutting teeth. Katoh specifically shows allowance for multiple sheets of material entering the area between the plate and the small tooth portions before the shredding action takes place between the large tooth portions and said plate. This is further evident in the design feature which compresses the shredded material. Thus, Katoh is teaching that multiple layers of a sheet material will be in the area between the large tooth portions and the plate. This is in contrast to the intent of this invention to set a clearance of a specified distance (approximately five thousandths of an inch or less) between the cutter and the internally radiused surface of the pinch plate.

Katoh further recognizes that the material is not being pierced and thus cut to a specified dimension in the first claim, section (e), and subsequent claims, wherein reference is made to shredding rather than to size reduction as is the case in this invention. (It should be noted that Katoh's use of the term "chips" in the description is not to be understood in the same light as the term is used in reference to this invention. Paper stock is a fiber and can be torn into small portions. That, however, is quite different from the size reduction of a semi-rigid material such as plastic into predetermined, controlled chip sizes.)

It must be further noted, that if small clearances were attempted with the design of Katoh, the cutter would bind on the plate in the reverse direction of rotation because of the location of the stationary cutting surface relative to the center line of the rotating cutter.

In none of the relevant references above is their achievement based on maintaining a precise dimensional clearance between the faces of any one cutter and the faces of any two opposing cutters; this is a significant technology of this invention which allows precisely dimensioned chips.

These differences are mentioned in order to show that neither Hatanaka or Katoh, nor any other prior art, has anticipated the present invention. The reference to these unique qualities does not, however, limit either the intent or the claims of this invention to these features as many additional unique qualities will be demonstrated throughout the body of this description.

It is, thus, a primary objective of this invention to provide granulate in a single pass which is sized by predetermined design and is essentially free of either fines or shreds. As will be seen in the following material, however, this invention has multiple objectives and is in no way limited to this single statement of purpose.

Thus, I am suggesting that the invention I am offering is both novel as compared with the prior art and will offer the end user significant utilitarian advantages.

OBJECTIVES OF THE INVENTION

This invention was developed with an understanding of the limitations of the previously described size reduction equipment. Furthermore, it was designed with a number of other objectives considering its potential application.

1. It is the general objective of this invention to provide size reduction equipment for plastic or other materials which, in a single pass, reduces the granulate to a predetermined, uniform size. That is, the granulate will conform to a specified dimension for both width and length subsequent to a single pass through the size reduction mechanism.
2. Another objective of the invention is to provide size reduction equipment which is compact and light enough to become readily portable in a mobile unit.
3. Another objective of the invention is size reduction equipment which is quiet in operation, allowing its use on mobile units in residential areas for waste recovery.

4. Another objective of the invention is to design the cutter unit in modular form so that it can be quickly installed or removed from its supporting structure for service.
5. Another objective of the invention is to provide an unencumbered means of adjustment for the opposable cutting surfaces.
6. Another objective of the invention is to provide escape channels within the cutter area so that the assembly is self cleaning.
7. Another objective of the invention is to provide a means of compressing the cutter and plate assemblies from a single maintenance surface of the equipment.
8. A final objective of the invention is to provide a drive train which is both robust and simple, yet which allows ease of removal of the cutter assembly.

These and other objectives and advantages of the present invention, and the manner in which they are achieved, will become apparent in the following specifications and claims.

SUMMARY OF THE INVENTION

In its basic concept, the present invention is a material size reduction system which employs counter-rotating shafts, having parallel axis of rotation, with mutually meshing cutters mounted thereon. Each opposing shaft has an arrangement of alternating cutters and spacers so that the cutters on one shaft occupy a space within the void created by the spacers between the cutters on the opposing shaft.

The cutter is a gear-like disc with formed teeth projecting from its periphery. The cutters are so mounted that, allowing only for working clearance, the faces of any given cutter are in intimate contact with a face of each opposing cutter. Approximately eighty degrees of arc of each cutter face is in contact with the face of the opposing, paired cutter.

Though the cutter geometry is not a subject of this patent, nothing its function is worthwhile. It has been determined that a cutter design with a pyramid tooth shape offers the greatest strength. A cutter of approximately 4¾ inch diameter with twenty four teeth has been the design of choice. As the cutter teeth rotate toward the opposing cutter's teeth, the material is gripped and drawn into the cutting area. During the actual cutting, two distinct actions are taking place. The first action is that of the opposing teeth piercing the material. This serrates the material with cross cut punctures the width of the cutter and parallel to the rotating shafts. The second action is achieved as the material is drawn into the overlapping area of the cutters. At this point, the material is scissor sheared between the opposing faces of the cutter perpendicular to the shaft.

Ideally, this cutting action produces chips which are the width of the cutter and the approximate length of twice the face length of a tooth. (That is, the length of the granulate is comparable to the distance between the two points when the material is deformed to conform to the valley between said points.) However, study has shown that, in reality, whenever multiple layers of material pass through the cutting area, two to three thickness layers adjacent to the tooth will be properly cut as indicated above. However, because the piercing action is impeded on the third and fourth layers away from the tooth, the material will deform, but will not be pierced by the tooth. The result is the generation of shreds.

Inasmuch as predetermined, uniform granulate is a primary objective of this invention, cutting the resulting shreds defined the mandatory criteria for the preferred embodiment of this plastic granulating equipment. This was achieved by adding a pinch plate against which the shred is pierced when it passes over the periphery of the rotating cutter. By so mounting the pinch plate that the clearance between an arc face of the plate and the opposing cutter teeth is substantially less than the thickness of the material passing through said clearance area, the material is pierced when passing through the cutting area in shred form. Thus, approximately seventy five percent of the granulate is generated in the upper area of the opposing cutter where the cutter teeth pierce the material. A remaining twenty five percent of the material passes as shreds and is dimensionally formed between the cutter teeth and the pinch plate.

DESCRIPTION OF THE PREFERRED EMBODIMENTS

Figure 1:
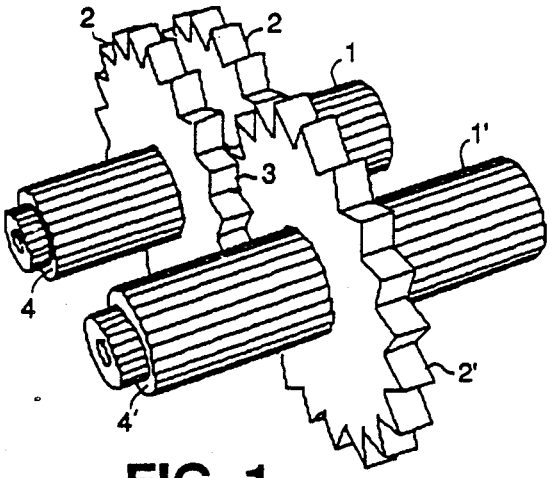
FIG. 1 is a perspective view of the preferred embodiment of the cutter and shaft showing a single cutter mounted on the first shaft, and two opposing, counter-rotating cutters mounted on the second shaft.

To simplify the description, symmetrical parts, or portions of a single part where divided by a sectional view, will be designated with a prime (′). The description of the part(s) having primed reference characters will be limited to a minimum.

Referring now to FIG. 1, the details of the preferred embodiment of the enhanced plastic size reduction cutter are illustrated. Two parallel, counter-rotating shafts 1, a first shaft, and 1′, a second shaft, are so located that alternating cutters 2, a first cutters, and 2′ a second cutter are mounted thereon. The first cutter and second cutter comprise what is referred to herein as a cutting assembly. The spacing between the centers of the shafts is such that the cutters overlap by approximately eighty degrees of arc at 3. In the preferred embodiment, the shafts 1 and 1' are so oriented that the shaft centers are in a plane parallel to the floor from any point between the shaft pair, or points along a single shaft from end to end.

In the preferred embodiment, the shafts rotate toward each other as viewed from the top. Thus, material fed to the cutters is drawn through the cutter assembly from the top and exits from the bottom.

A reduced diameter is shown on the end of the shaft 4 which accommodates a compression spacer. This detail will be further explained in following views.

Figure 2:
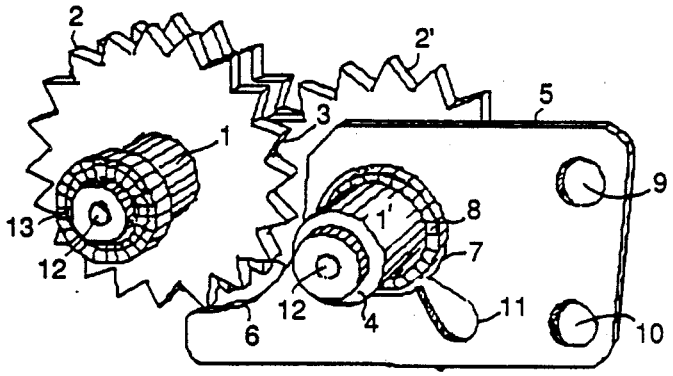
FIG. 2 is a perspective view of the preferred embodiment of the cutter and shaft showing a pinch plate mounted axially to the first shaft, and an opposing cutter mounted on the secondd shaft.

FIG. 2 illustrates the principle cutting chamber parts in their working relationships. As referred to previously, the shafts 1 and 1' are located so that the alternating cutters 2 and 2' overlap at 3 which defines a cutting chamber. Opposite each cutter 2 or 2' is a pinch plate 5. The primary function of the pinch plate 5 is to provide an internally radiused surface at 6 with a running clearance from the cutter 2 or 2' less than the thickness of the material, which causes the cutter teeth, or cutter means, to pierce any material drawn between the cutter 2 or 2' and the internally radiused surface 6 of the pinch plate 5.

FIG. 2 also shows the shaft opening 7 in the center of the pinch plate 5 which accommodates a shaft spacer 8. This shaft spacer 8 rides on the shaft 1 and is in intimate contact with any two cutters 2 or 2' on the same shaft. The shaft opening 7 is of such a design and clearance that the shaft spacer 8 will not come in contact with the pinch plate 5 within the allowable adjustment range of said pinch plate 5.

The pinch plate 5 is affixed to mounting bars which pass through the plate at the mounting holes 9 and 10. The upper mounting hole 9 is a pivot point by which adjustment of the pinch plate's internally radiused surface 6 and the cutter 2 or 2' clearance is achieved. Consequently, the upper mounting hole 9 is provided with only a clearance diameter for the mounting bar. During adjustment, the bottom mounting hole 10 swings an arc from the center of mounting hole 9, thus the bottom mounting hole 10 provides sufficient clearance for full adjustment movement of the pinch plate 5.

The pinch plate has a tear-drop shaped opening identified as a purge hole 11. This opening affords an exit path to extraneous material drawn between the cutter 2 or 2' and the pinch plate 5.

This figure also shows the center, threaded mounting hole 12 in the shaft and the compression spacer 13 on the end of a shaft.

Figure 3:
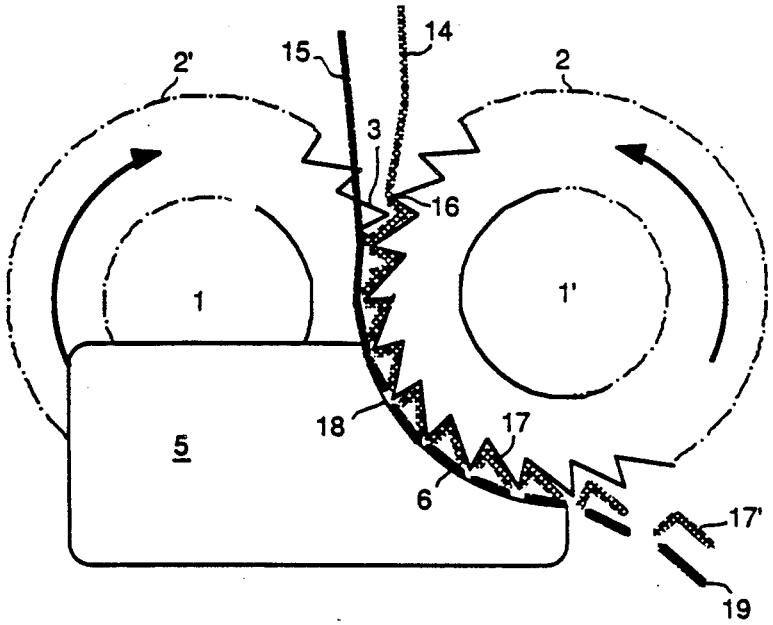
FIG. 3 is a diagrammatic representation showing the action of a material passing through the cutters and pinch plate of the present invention.

FIG. 3 is a graphic representation of the action of the opposing cutters 2 and 2' as they pierce and shear the material. The opposably rotating cutters 2 and 2' are used to draw the material into the cutter assembly. As the layers of material 14 and 15 pass into the cutter area, the layers adjacent to the cutter 14 are gripped by the cutter teeth and pierced at 16. The material continues into the cutter overlap area 3 and is sheared. When the material is both pierced at 16 and sheared at 3, the result is a properly formed chip 17 in a cutter tooth which is ejected at the bottom of the cutter head, as depiced at 17'. However, when multiple layers of material pass through the cutters, an outside layer 15 (which usually represents approximately twenty-five percent of the material by weight) is often pleated but not pierced. In an operation without the use of the specially designed pinch plate of this invention, the shred would pass through the cutter assembly and be co-mingled with the acceptable chips. However, by forcing the shred to pass through the restricted area between the cutter 2 or 2' and the internally radiused surface 6 on the pinch plate 5, the outside material 15 is pierced at 18 and is ejected from the bottom of the cutter as a properly formed chip 19. The predetermined clearance between the cutter 2 or 2' and the internally radiused surface 6 of the pinch plate 5 is less than the thickness of the material. (In practice, this dimension may be held to approximately five thousandths of an inch or less.)

It should be obvious that this invention has developed a cutter configuration with two, independent cutting actions. The primary location of the cutting action is at 16 where the material is pierced and subsequently shredded by the action of the opposing cutter faces at 3. In the event that a material is not properly reduced to chips in the primary cutting area 3, the material is pierced as it passes through the secondary cutting area of the internally radiused surface 6, of the pinch plate 5. At this secondary location, the same piercing action takes place on the shred which was inadvertently omitted in the primary cutting area 3.

Figure 4:
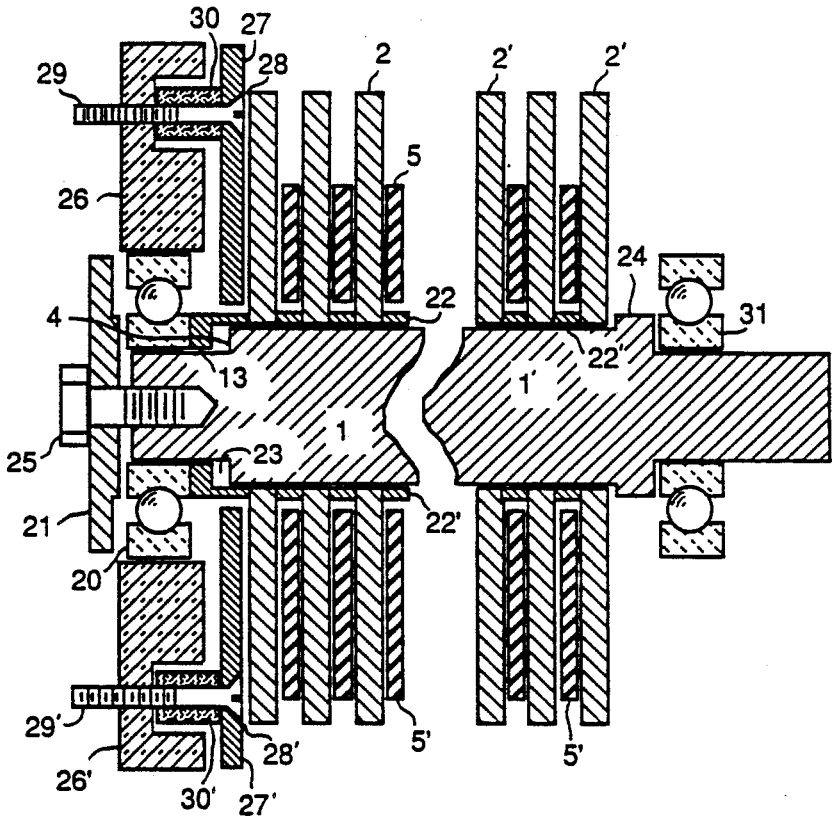
FIG. 4 is a side sectional elevation view of the driver shaft showing the shaft, spacers, cutters, pinch plates, side clearance adjustment plate, and the means of rigidly clamping the cutters with the clamping collar.

FIG. 4 illustrates the driving shaft assembly comprised of the shaft 1, the anti-friction bearings 20 and 31, the cutters 2, the compression spacer 13, the shaft spacers 8, and the compression plate 21. It should be apparent in the detail of this shaft that provision has been made to rigidly locate the cutters on the shaft so that the space between the cutters 2 is held to that of the shaft spacer 22 thickness. This is accomplished by compressing the compression plate 21 into the anti-friction bearing 20, which in turn compresses the compression spacer 13. The reduced portion of the shaft 4 is so constructed that the anti-friction bearing 20 protrudes beyond the shaft, causing the compressive force to be transmitted to the bearing rather than to the shaft. The compression spacer 13 is designed so that there is an open space 23 between itself and the shaft 1. Thus, the compressive force applied to the anti-friction bearing and the compression spacer 13 is transmitted directly to the first cutter 2. Inasmuch as all cutters 2 and spacers 22 on the shaft are in intimate contact, the compressive force against the compression spacer 13 is finally brought to bear against the shaft shoulder 24. In this way, tensioning the fastener 25 on the end of the shaft locks all cutters immovably on the shaft in relationship to their spacing. (This invention is not concerned with the means of limiting the rotation of the cutters 2 or 2' on the shaft 1 or 1'. Such rotational limitation is provided with a known key arrangement.)

It should be noted that the anti-friction bearing 20 tolerances to both the reduced shaft area 4 and the end plate 26 are sufficiently loose so that the bearing can float to accomplish the compression of the assembly on the shaft. It should therefore be apparent that the end play of the shaft assembly is limited by the anti-friction bearing 31 which is rigidly located in relation to both the shaft 1 and its outer bearing housing (which is not shown).

Also shown in this figure are the details of the cutter clearance adjustment plate 27. This plate is provided so that, subsequent to assembly, the clearance 28 between the final cutter 2 on the shaft and the adjustment plate 27 can be properly set. (The clearance is approximately six thousandths of an inch.) This adjustment is achieved by tensioning a fastener 29 against a resilient elastomeric body 30 which moves the clearance adjustment plate 27.

Figure 5:
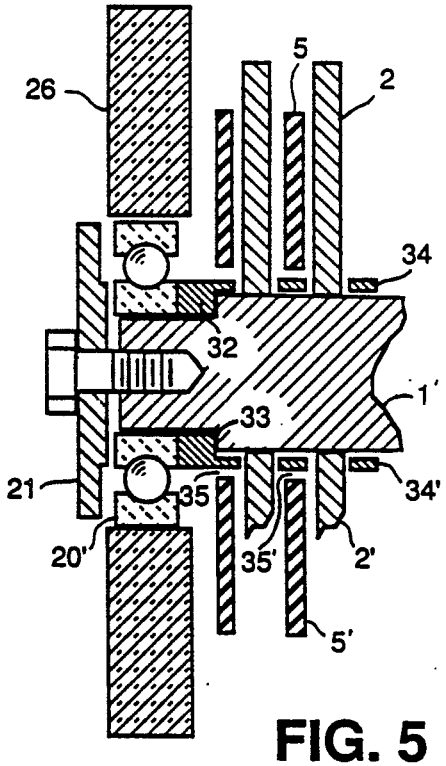
FIG. 5 is a side sectional elevation view of the driven shaft which shows the means of mounting the cutters so that they can self-align with the opposing cutters on the driving shaft.

FIG. 5 shows a partial view of the driven shaft assembly comprised of the shaft 1', the anti-friction bearing 20', the cutters 2', the shaft end spacer 32, the shaft spacers 8, and the compression plate 21'. In contrast to the driver shaft on which the cutters are rigidly located, the cutters on this driven shaft 1' are so mounted that they have a certain freedom of axial movement. This floating design is necessary so that the cutters 2' on the driven shaft 1' will properly align between the rigidly mounted cutters 2 on the driver shaft 1. This movement is made possible by constructing the shaft end spacer 32 so that a compressive force on the anti-friction bearing 20' by the compression plate 21' forces the shaft end spacer 32 in compression against the shaft 1' at 33. The driven shaft spacer 34 is dimensioned narrower than the cutter 2' so that the series of cutters have some freedom of movement on the shaft 1'.

This figure also clearly shows the clearance 35 allowed between the rotating driven shaft spacer 34 and the pinch plate 5. (This same clearance is provided between the driver shaft spacer 8 and the pinch plates 5 mounted on shaft 1.)

Figure 6:
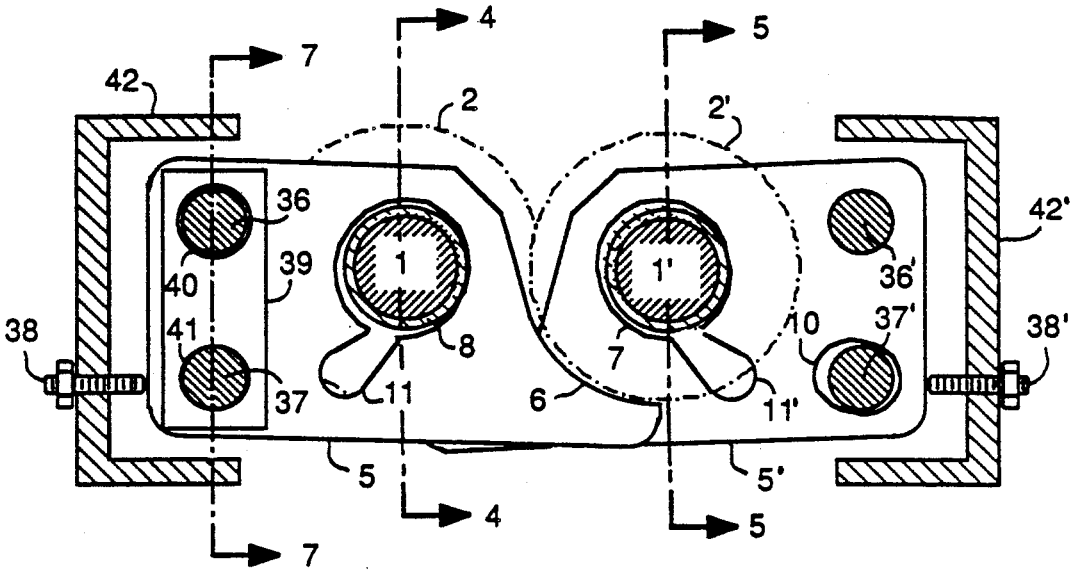
FIG. 6 is a front elevation and partial sectional view of the entire unit showing the relationship of the pinch plates, main shafts, cutters, pinch plate mounting bars, and the pinch plate adjustment means.

FIG. 6 shows an assembly view of the entire enhanced cutter assembly. In this view, it should be apparent that provision has been made for adjusting the clearance between the internally radiused surface 6 of the pinch plate 5 and the cutter 2 or 2'. The pinch plate 5 is mounted on the upper mounting rod 36 with only a clearance fit so that the plate pivots about this point. A lower mounting rod 37 passes through the series of pinch plates 5 but does not restrict said freedom to pivot because of an elongated or enlarged mounting hole at 10. Pinch plate 5 adjustment is accomplished by an adjusting set screw 38 which moveably bears against said plate. The shaft opening 7 in the pinch plate 5 is so constructed that proper clearance is maintained at any limit of adjustment of said plate.

Figure 7:
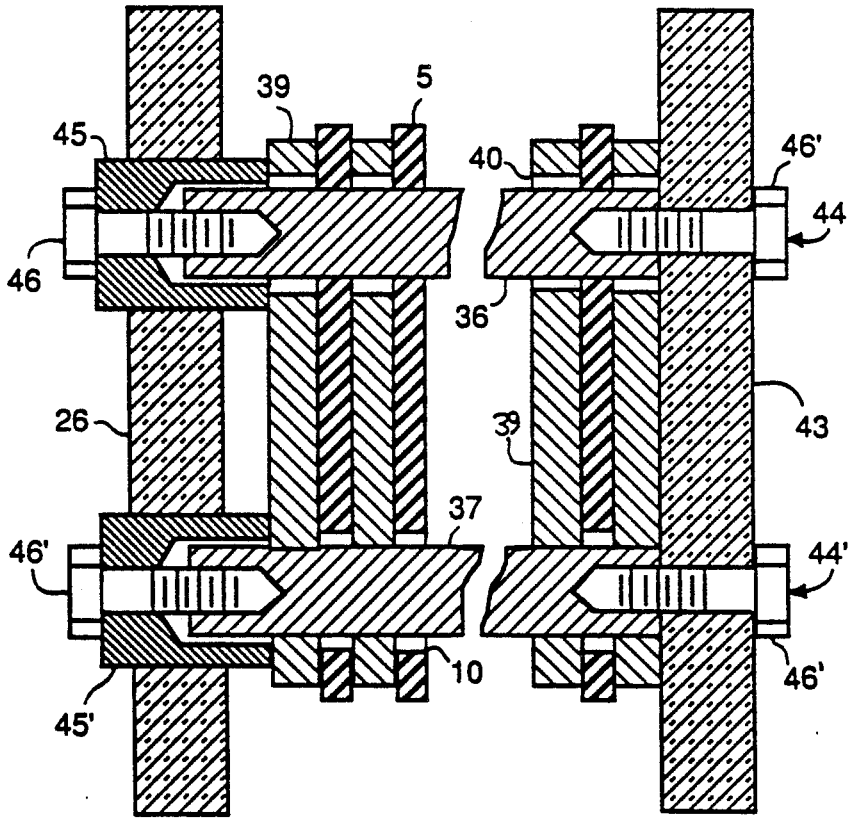
FIG. 7 is a side sectional elevation view of the pinch plate and pinch plate spacer mounting bars, and the means of compressing said members into an immovable assembly along section 7—7 of FIG. 6.

Provision is made to rigidly restrain movement of the pinch plates 5 upon completion of adjustment procedures. Pinch plate spacers 39 separate the pinch plates and transmit a compressive force applied to said spacers from the upper 36 and lower 37 mounting rods. (Details of the compressive means are shown in FIG. 7.) The pinch plate spacer 39 is constructed with an upper opening 40 which has ample clearance for mounting ease, whereas the lower opening 41 is only nominally larger than the lower mounting rod 37. In this way, when the assembly of pinch plate spacers 39 and the pinch plates 5 are compressed, the assembly cannot pivot on the upper mounting rod 36, as the enlarged mounting hole 10 is effectively restrained.

FIG. 6 shows the details of the box assembly 42 which constitutes the outside frame of the unit.

FIG. 7 shows the detail of the upper 36 and lower 37 mounting rod configuration and the means of compressing the pinch plates 5 and pinch plate spacers 39. The fixed end plate 43 has mounting means 44 for the upper 36 and lower 37 mounting rods to which said rods are immovably attached. In final assembly after the pinch plates 5 are properly adjusted, the mounting rod locking sleeves 45 are drawn into compression by the fasteners 46. Locking sleeves 45 and fasteners 46 comprise mounting means 44. This compresses the entire stack of pinch plates 5 and pinch plate spacers 39 against the fixed end plate 43 by tensioning the mounting rods 36 and 37. The mounting rod locking sleeves 45 are slidably located in end plate 26. Note the clearances in 10 and 40, which were referred to in the description of FIG. 6.

Figure 8:
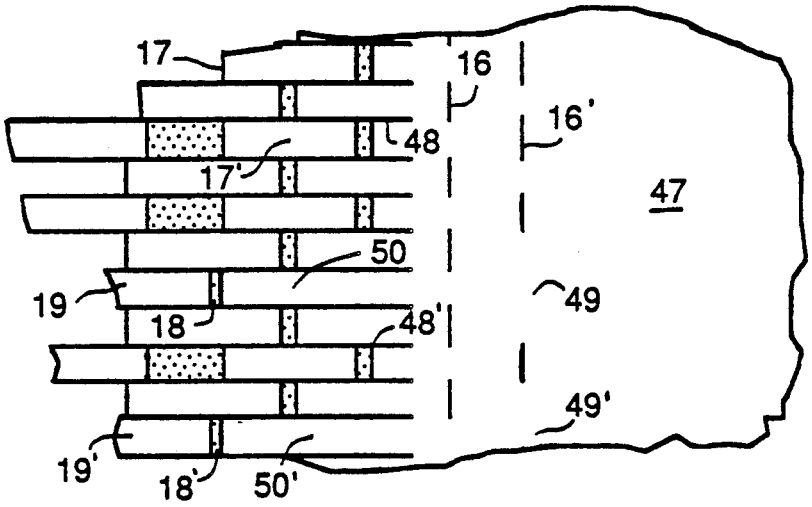
FIG. 8 is a representation of the cutting pattern across a sheet of plastic material.

FIG. 8 indicates the cutting pattern as seen on a flat material 47 partially fed into the cutting area. The material is initially pierced at 16, which produces the cross cut. As the material 47 moves through the cutters, it is sheared at the cutter overlap area 3 (as shown in FIG. 3), resulting in the longitudinal cut at 48 which produces a predetermined, uniform granulate size. In some cases, however, the material is not pierced, as at 49, resulting in a shred at 50. In this instance, the shred is pierced 18 against the internally radiused section 6 of the pinch plate 5 (shown in FIG. 3) as a secondary or supplemental cutting action which produces chip 19.

Figure 9:
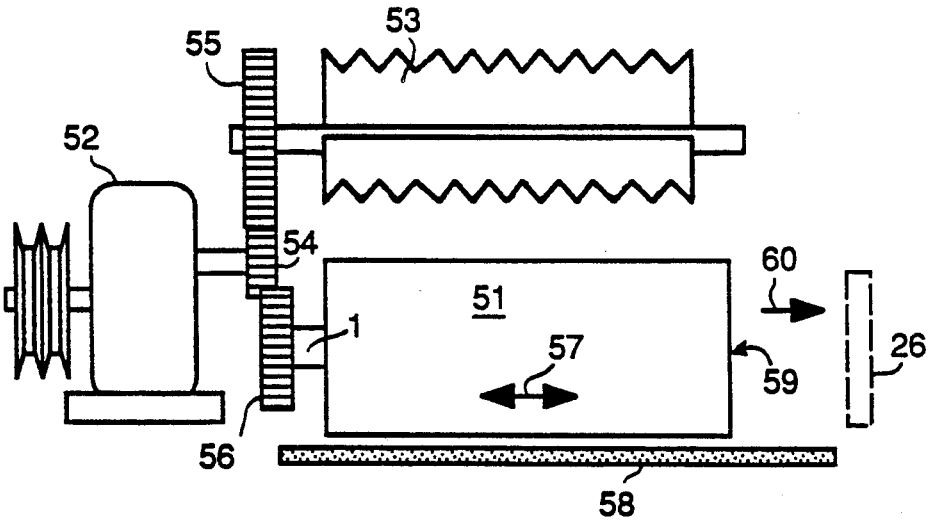
FIG. 9 is a side elevation view showing the relationship of the removable cutter unit, the drive train, and the stationary crammer unit.

Finally, FIG. 9 depicts a mounting system which allows rapid changing of the cutter head assembly 51. The operational unit will have a multiplicity of stationary units such as a drive gear box 52, and a material crammer 53. The drive members are mounted so that a gear box output drive spur gear 54 meshes with other driven components, such as the crammer spur gear 55 and the cutter driver shaft 1 spur gear 56. The cutter head assembly 51 is modular in construction so that none of its internal component parts are dependent on the supporting structure of the chasis (not shown) as a means of mounting or location. All component parts of the cutter head are mounted to either end plate 26 or 43 or the box assembly 42. With this arrangement, it is possible to remove the cutter head assembly 51 from the drive unit by sliding the cutter head assembly 51 away from the gear drive 54 on the axis of the driver shaft spur gear 56 as indicated by the arrows 57. A base member provides a track 58 area on which the cutter assembly 51 can be moved. The cutter assembly and drive components are mounted to, and within, a chasis which is not shown. Provision is made for a clamping means on said chasis to rigidly secure the cutter head assembly 51 at a readily accessible exterior point, such as 59.

OPERATION

In the preferred embodiment, as illustrated in FIG. 2 and graphically represented in FIG. 3, multiple sheets of waste material (most specifically plastic) are fed into the cutters 2 from above. The material 14 is gripped by the counter-rotating cutters 2 and is drawn into the cutting chamber 3 where it is first pierced at 16 and then sheared between the faces of any two opposing cutters 2 and 2'. Approximately seventy five percent of the material will be properly cut in both planes and will form a chip as indicated by 17 in FIG. 3.

However, when multiple layers of material pass through the cutter, the layer farthest from the cutter as indicated by 15, will often pass through the opposing cutters as a shred without being pierced at 16. In this case, the pinch plate 5 assembly will nip the shred between the cutter teeth and the internally radiused surface 6 of the pinch plate, forming properly shaped granulate.

In order to properly shear the material between opposing cutter faces, it is necessary that overlapping cutters be in initimate contact (allowing only an operating clearance of one to two thousands of an inch) and not deflect. In order to achieve rigidity of the cutter 2 attachment to the shaft 1, the cutters 2 and shaft spacers 22 are stacked on the shaft so that tensioning the fastener 25 on the shaft end will immovably secure the cutters on the shaft 1. It should be readily apparent, however, that some freedom must be granted the opposing set of cutters 2' in order to avoid misalignment under compression of the two sets of cutters. Thus, on the driven shaft 1' as shown in FIG. 5, the cutters 2' are mounted with non-compressive shaft spacers 34 so that the assembly is not rigidly mounted on the shaft. This degree of freedom allows the cutters 2' to become self-aligning to those of the cutters 2 on the driving shaft.

The pinch plates 5 serve other important functions in addition to that of the internally radiused surface 6. They are important in keeping shreds from wrapping around the rotating shaft. Though said function is not a claim of this invention, it is essential in keeping the shaft free of contaminants. An important feature of the pinch plate is the tear drop-shaped purge hole 11. As the cutter 2 rotates next to the pinch plate 5, a small percentage of material is inadvertently drawn into the space between the cutter 2 and the pinch plate 5. The purge hole 11 becomes an escape channel through which this material may flow, causing the assembly to be self cleaning.

In order to avoid a thrust stress to the anti-friction bearings 20, the bearing mounting plate 26 on the adjustment side allows the bearing to float after the fastener 25 has been secured. The shaft end-play is secured by mounting the shaft bearing immovably (not shown) in relationship to the shaft on the drive side of each respective shaft.

Inasmuch as cutter clearance to the housing is critical, FIG. 4 shows how provision is made for adjusting this clearance 28. By setting the tension of the plate fasteners 29, the cutter clearance adjustment plate 27 may be moved toward—or away from—the face of the cutter to establish proper clearance.

The clearance between the cutter 2 and its opposing cutting surface on the internally radiused surface 6 of the pinch plate 5 must be set to a proper distance at both initial assembly of the unit, and as a consequence of wear. In order to achieve this adjustment, as indicated in FIG. 7, the fasteners 46 on the upper 36 and lower 37 mounting rods are released, which removes the compressive force from the mounting rod locking sleeves 45, the pinch plate spacers 39, and the pinch plates 5 proper. With the compression thus released, it is possible to adjust said clearance by manipulating the pinch plate adjustment set screws 38.

In any counter-rotating cutter design which uses a plurality of cutters, maintenance of the cutters requires free access to the cutter area for repair. In most designs, this requires the removal of drive and feed systems as well as the necessity of working within an encumbered machine area. In this invention, a unique feature is offered in which the cutter assembly is readily removable for enhanced ease of maintenance. Referring to FIG. 9, it is apparent that, with the release of a locking system at a readily accessible exterior point 59, the entire cutter head assembly 51 may be removed for repair or substitution with a re-built unit.

To facilitate repair of the unit, the cutter head assembly is so built, that with the removal of the housing end plate 26 in the direction of arrow 60, all internal components may be removed by sliding them from their respective shafting. In referring to FIG. 4 and FIG. 7, it should also be apparent that all compression fasteners are manipulated from the face of the end plate 26.

A maintenance service cart (not shown) has also been designed to facilitate work on the cutter head assembly. The unique features of said cart are, 1) a slide area which duplicates that of the track 58 on the main structure holding the cutter head assembly 51; 2) and a hand crank driven gear which aligns with the shaft spur gear 56 allowing manual manipulation of the cutters 2 and 2' for service and adjustment of the pinch plate 5.

While the present invention has been disclosed with respect to a preferred embodiment and modification thereto, further modifications will be apparent to those of ordinary skill in the art within the scope of the claims that follow. It is not intended that the invention be limited by the disclosure, but instead that its scope be determined by reference to the claims which follow herein below.

The embodiments of the invention in which an exclusive property or privilege is claimed are defined below.

What I claim is:

1. A material size reduction mechanism for cutting a workpiece, having a nominal thickness, to a predetermined, uniform finished size, comprising:

a cutter assembly for cutting, longitudinally and transversely, a workpiece, including a set of first cutter discs carried on a first shaft and a set of second cutter discs carried on a second shaft, said first cutter discs being axially and rotatably fixed on said first shaft, said second cutter discs being axially shiftable on said second shaft, wherein said first and second cutter discs are constructed and arranged to mesh, thereby defining a cutting chamber wherein a primary cutting action occurs, wherein said shafts include a shoulder against which a series of cutters and spacers may be located;

a stationary surface located adjacent each cutter disc and spaced apart therefrom by a predetermined distance to provide a secondary cutting action with its associated cutter, wherein said predetermined distance is less that the nominal thickness of the workpiece; and mounting means which includes a spacer mounted between adjacent cutters, a compression spacer located at the end of a shaft bearing against the final cutter in a series, an anti-friction bearing mounted on a shaft such that it may be slidably positioned to put a series of spacers and cutters under a compressive load on a shaft, and a compression plate, mountable from the exposed end of the shaft, which will exert a compressive force on said series of cutters, spacers and on said anti-friction bearing.

2. The material size reduction mechanism of claim 1 wherein said stationary surface includes an internal radius conforming to that of the periphery of the cutter surface with which it interacts and wherein said stationary surface is substantially below the center line of the shaft to accommodate rotation of the cutter discs in either direction;

mounting means for the stationary surface including a plate opposing, and in a plane with, the cutter disc with which it interacts, means for moving and locating said stationary surface for proper working clearance by means of an extendable threaded member adjustably bearing against a surface of said plate;

means constraining movement of said plate by a locking sleeve held in compression against a multiplicity of spacers and plates on a common mounting rod; and a purge opening in said plate which allows entrapped material to escape when lodged between said plate and the adjacent cutter member.

3. The material size reduction mechanism of claim 1 which includes an adjustable cutter clearance plate comprising:

a movable plate adjacent to the face of a last cutter in a series on a shaft;

a multiplicity of adjustable fasteners; and an arrangement of resilient mounting members against which the adjustable fasteners are biased which affect the movement and permanent displacement of said plate.

4. The material size reduction mechanism of claim 1 which includes means to facilitate the ready removal of the cutter head assembly, including:

a support structure constructed and arranged to permit removal of said cutter head assembly;

a spur gear drive connecting a prime mover with the cutter head assembly which allows said cutter head assembly to be slidably removable from the support structure;

a spur gear drive assembly which powers all other moving equipment independent of the spur gear and shaft of the cutter head assembly; and a locking assembly which secures the cutter head assembly from a single, readily accessible location.

5. The material size reduction means of claim 1 which includes means to facilitate disassembly of the cutter head assembly of said size reduction equipment, including an end plate which, upon its removal, allows the extraction of all other normally replaced or serviced components which includes a multiplicity of securing functions for internal components.

6. A material size reduction mechanism for generating a product having a predetermined, uniform finished size comprising:

a rotating cutter assembly including opposing counter-rotating cutters, having mutually meshing cutter discs, with cutting means arranged about the periphery of said cutter discs which perform a primary cutting action;

a stationary surface against which the rotating cutter discs execute a secondary cutting action which is independent of the primary cutting action;

opposed, cutter-disc-carrying drive shafts, including a first shaft and a second shaft, each having a series of cutters and spacers mounted thereon, for in said cutters and spacers are mounted on said first shaft with no latitude of movement, and wherein said cutters and spacers are mounted on said second shaft with sufficient latitude of movement, in a direction parallel to the shaft, to allow said cutters to freely position themselves when located by a series of cutters and spacers on said first shaft;

a stationary surface having an internal radius conforming to that of the periphery of the cutter disc surface with which it interacts, wherein said stationary surface is located substantially below the center line of the cutter shaft to accommodate rotation, in either direction without binding, between said stationary surface and the opposing cutter, wherein a nominal operating clearance is provided between said cutter discs and associated opposing stationary surfaces, which operating clearance is less than the nominal thickness of the material passing between said cutter and said stationary surface;

mounting means for the stationary surface in the form of a plate opposing, and in a plane with, the cutter with which it interacts;

a means of moving and locating said stationary surface for proper working clearance by means of an extendable threaded member adjustably bearing against a surface of said plate;

means constraining movement of said plate by a locking sleeve which is held in compression against a multiplicity of spacers and plates on a common mounting rod; and a purge opening on said plate which allows entrapped material to escape when lodged between said plate and the adjacent cutting member.

7. The material size reduction mechanism of claim 6, further including means for mounting said cutters on their respective drive shafts, comprising:

a shoulder on each shaft against which a series of cutters and spacer may be located;

a spacer mounted between adjacent cutters;

a compression spacer at the end of a shaft bearing against the final cutter in a series;

an anti-friction bearing mounted on a shaft such that it may be slidably positioned to put a series of spacers and cutters under a compressive load on a shaft; and a compression plate, mountable from the exposed end of the shaft, which will exert a compressive force on said series of cutters, spacers, and said anti-friction bearing.

8. The material size reduction mechanism of claim 6, which includes an adjustable cutter clearance plate comprising:

a movable plate adjacent to the face of a last cutter in a series on a shaft;

a multiplicity of adjustable mounting means comprised of threaded fasteners;

an arrangement of resilient mounting members against which the mounting means are biased which affect the movement and permanent displacement of said plate.

9. The material size reduction mechanism of claim 6, wherein a mechanism is incorporated to facilitate the ready removal of the cutter head assembly, including:

a support structure;

a spur gear drive connecting a prime mover with the cutter head assembly which allows said cutter head assembly to be slidably removable from the support structure;

a spur gear drive assembly which powers all other moving equipment independent of the spur gear and shaft of the cutter head assembly; and a locking assembly which secures the cutter head assembly.

10. The material size reduction mechanism of claim 6, which includes means to facilitate disassembly or maintenance of the cutter head assembly, including:

an end plate which, upon its removal, allows the extraction of all other normally replaced or serviced components which includes a multiplicity of securing functions for internal components.

* * * * *